United States Patent [19]

Klosterman

[11] Patent Number: 4,772,041

[45] Date of Patent: Sep. 20, 1988

[54] SIMPLIFIED ADJUSTABLE SKI BINDING STRUCTURE

[76] Inventor: James E. Klosterman, 466 Chatham Dr., Dayton, Ohio 45429

[21] Appl. No.: 17,265

[22] Filed: Feb. 20, 1987

[51] Int. Cl.[4] ..... A63C 9/08

[52] U.S. Cl. ..... 280/611; 280/618; 280/633; 36/97

[58] Field of Search ..... 280/611, 615, 607, 614, 280/636, 618, 633; 36/97, 7.1 R

[56] References Cited

U.S. PATENT DOCUMENTS

| | | | |
|---|---|---|---|
| 3,057,086 | 10/1962 | Rigsby | 36/97 |
| 3,762,075 | 10/1973 | Munschy | 36/97 |
| 3,951,424 | 4/1976 | Napflin | 280/633 |
| 4,389,200 | 6/1983 | O'Brien | 280/618 |

OTHER PUBLICATIONS

Edsbyn, 1986/87, Ski Catalog.

*Primary Examiner*—Richard A. Bertsch
*Attorney, Agent, or Firm*—Jacox & Meckstroth

[57] ABSTRACT

A simplified adjustable ski binding structure which includes a base portion which can be formed from a single sheet of material. The sheet of material which forms the base has portions which are folded and portions which are angularly moved to form a heel section. An attachment portion is attached to the heel section. In one embodiment the attachment portion is integral with the heel section. The attachment portion has a series of apertures by which the attachment portion can be adjustably attached to a ski to receive a small boot or a large boot or a boot intermediate in size.

25 Claims, 3 Drawing Sheets

FIG-11
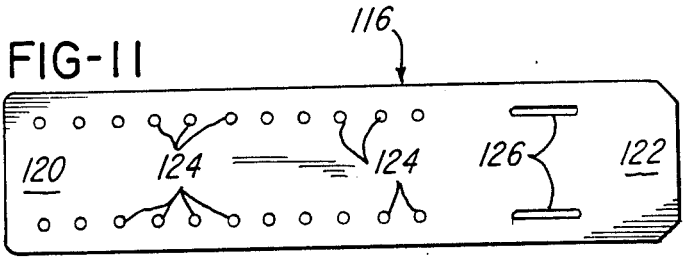
FIG-12
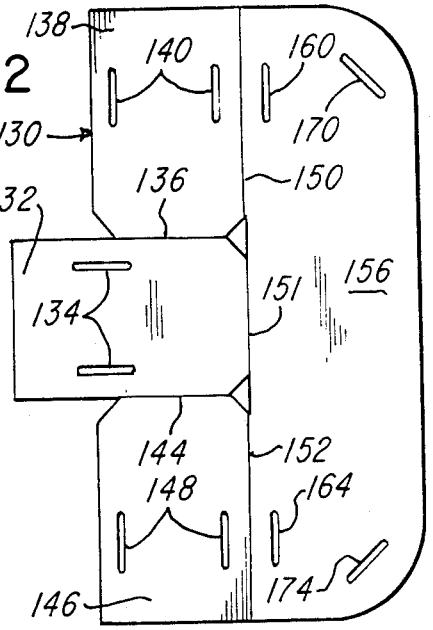
FIG-13
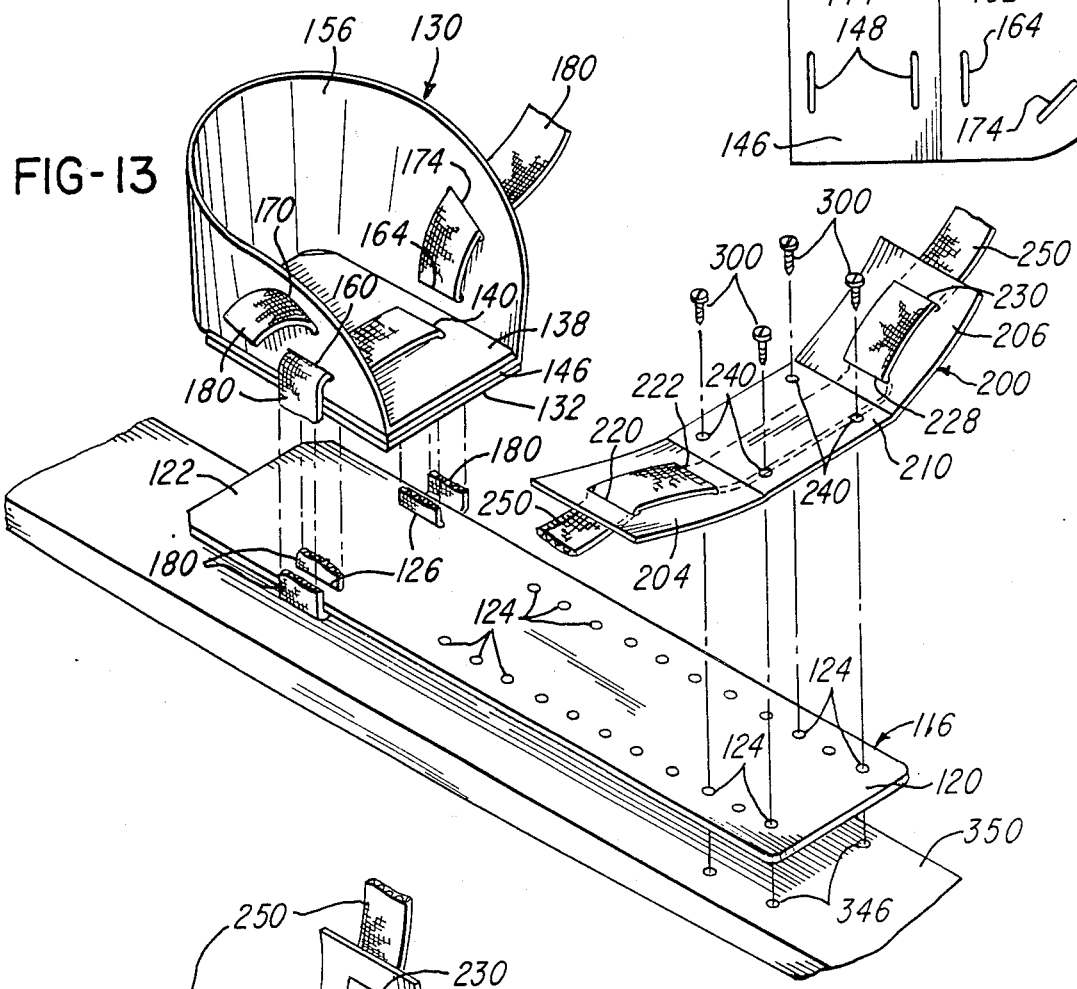
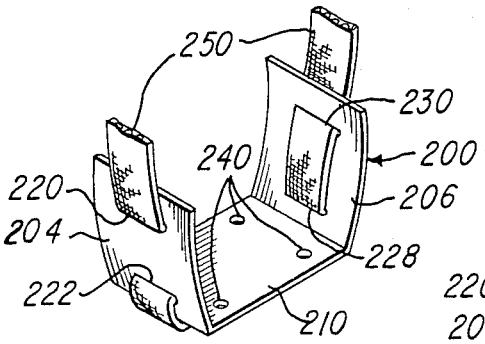
FIG-15
FIG-14
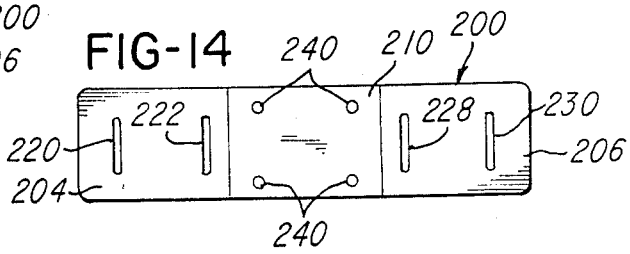

SIMPLIFIED ADJUSTABLE SKI BINDING STRUCTURE

BACKGROUND OF THE INVENTION

In order for a person to use a pair of skss a ski binding structure is attached to each ski and the ski binding structure is adapted to receive the person's ski boot or shoe.

The ski binding structure must snugly fit the boot. Conventionally, only the forward part of the ski binding structure is attached to a ski and permits raising of the heel of the boot and the heel portion of the ski binding structure.

A problem has existed with regard to a ski binding structure for children. Of course, a child's foot grows and requires larger boots. In the past, in order to provide a ski binding structure which snugly fits a child's boot, it has been necessary periodically to purchase new ski binding structures as the child's foot grows and as the child wears larger boots. Naturally significant expense and trouble are involved as it is necessary to periodically obtain a new pair of ski binding structures for a child as the child grows.

It is an object of this invention to provide a ski binding structure which is adjustable in size and which may be used by a child when the child's boots are relatively small and which can be used by the child as the child grows and wears larger and larger boots.

Another object of this invention is to provide a ski binding structure which is adjustable in size and which can be used by persons having any one of a plurality of boot sizes.

It is another object of this invention to provide a base of a ski binding structure in which the base can be constructed from a single piece of material.

It is another object of this invention to provide a single piece ski binding base which is constructed to receive a right boot or a left boot.

Another object of this invention is to provide a ski binding structure which can be constructed with relatively low costs.

Another object of this invention is to provide a ski binding structure which is easily and readily adjustably attachable to a ski and which is easily and readily removable from a ski.

Other objects and advantages of this invention reside in the construction of parts, the combination thereof, the method of construction and the mode of use, as will become more apparent from the following description.

SUMMARY OF THE INVENTION

The preferred embodiment of this invention includes a one-piece ski binding base which is adjustable in size and which is adapted to receive a small boot or a large boot and which is adjustable to receive any one of a plurality of boot sizes between a small boot size and a large boot size.

In the preferred embodiment which provides a one-piece ski binding base, the base is formed from a flat sheet. The flat sheet is formed into a plurality of portions. The portions are relatively movable to form the base of a ski binding structure. The base includes a heel receiving section. The one piece ski binding base, preferably, has an elongate attachment portion which extends from the heel receiving section to a toe receiving section. The attachment portion is provided with means along the length thereof for attachment to a ski whereby the spacing between the heel portion and the toe portion is adjustable.

In another embodiment of this invention, the ski binding structure comprises a plurality of portions, one portion being a heel receiving portion, another portion being a toe portion and another portion being an attachment portion to which the heel portion and the toe portion are attachable.

BRIEF DESCRIPTION OF THE VIEWS OF THE DRAWINGS

FIG. 11 is a plan view or lay-out view showing a portion of another embodiment of the ski binding structure of this invention.

FIG. 12 is a plan view or lay-out view showing another portion of the embodiment of the ski binding structure of FIG. 11.

FIG. 13 is a fragmentary perspective exploded view showing the embodiment of FIGS. 11 and 12 and illustrating attachment thereof to a ski.

FIG. 14 is a plan view or lay-out view of a piece of material adapted to form a toe portion of the ski binding structure of this invention shown in FIG. 13.

FIG. 15 is a fragmentary perspective view of the piece of material of FIG. 14, formed into a toe portion of the ski binding structure which is shown in FIGS. 13 and 14 and including a securing member.

DETAILED DESCRIPTION OF THE INVENTION

Figure 1:
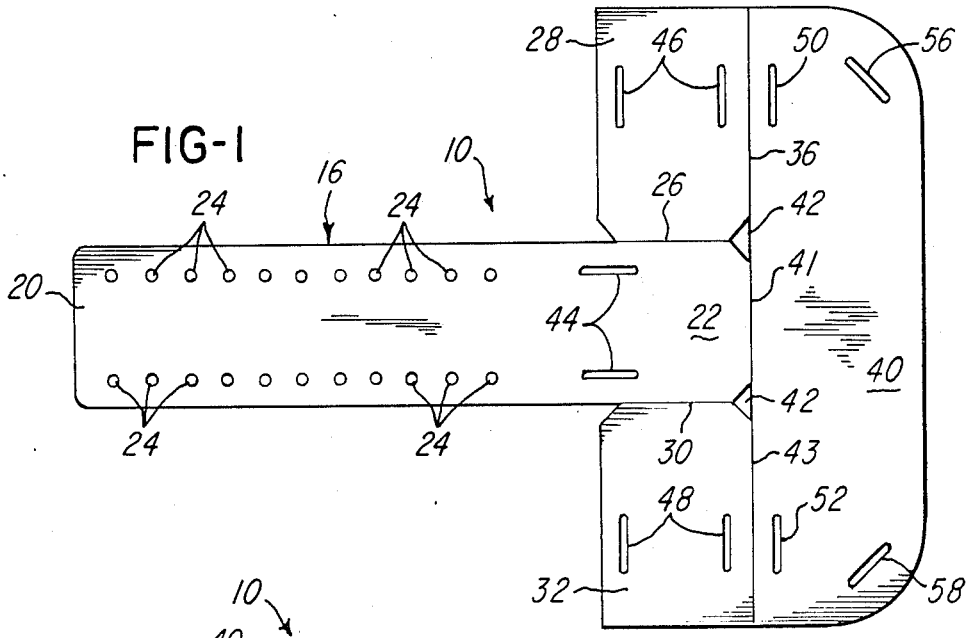
FIG. 1 is a plan or lay-out view showing a single piece of material from which a base portion of ski binding structure is constructed in accordance with this invention.

The preferred embodiment of this invention is shown in the lay-out view of FIG. 1. This figure shows a single sheet of material which is adapted to be formed into a ski binding base 10. The single sheet of material, may comprise a sheet of plastics material, or leather material or any other reasonably flexible and sturdy material. The base 10 has an elongate attachment portion or bottom portion 16. The attachment portion or bottom portion 16 has an end part 20 and a connection part 22. Between the end part 20 and the connection part 22, the attachment portion 16 is provided with a series of pairs of apertures 24.

A cut line 26 separates the connection part 22 of the attachment portion 16 from a flap portion 28. A cut line 30 separates the connection part 22 from a flap portion 32.

A fold line 36 separates the flap portion 28 from an elongate flap portion 40. A fold line 41 separates the connection part 22 of the elongate attachment portion 16 from the elongate flap portion 40. A fold line 43 separates the elongate flap portion 40 from the flap portion 32.

Notches 42 are shown between the cut line 26 and the fold line 36 and between the cut line 30 and the fold line 43.

The elongate attachment portion 16 is provided with a pair of slots 44 adjacent the connection part 22 of the attachment portion 16. The slots 44 are shown as being substantially parallel to each other and substantially parallel to the longitudinal axis of the attachment portion 16.

The flap portion 28 has a pair of slots 46 which are shown as being substantially normal to the slots 44. The flap portion 32 has a pair of slots 48 which are shown as being normal to the slots 44 and are shown as being in alignment with the slots 46 of the flap portion 28.

The elongate flap portion 40 has a slot 50 and a slot 52, which are shown as being in alignment, one with the other, and adjacent the fold lines 36 and 43, respectively. The slot 50 is shown as being in lateral alignment with the slots 46 of the flap portion 28. The slot 52 is shown as being in lateral alignment with the slots 48 of the flap portion 32.

The elongate flap portion 40 is also shown as having a slot 56 and a slot 58. The slots 56 and 58 are shown spaced from the slots 50 and 52, respectively, and are at angles with respect to the slots 50 and 52.

Figure 2:
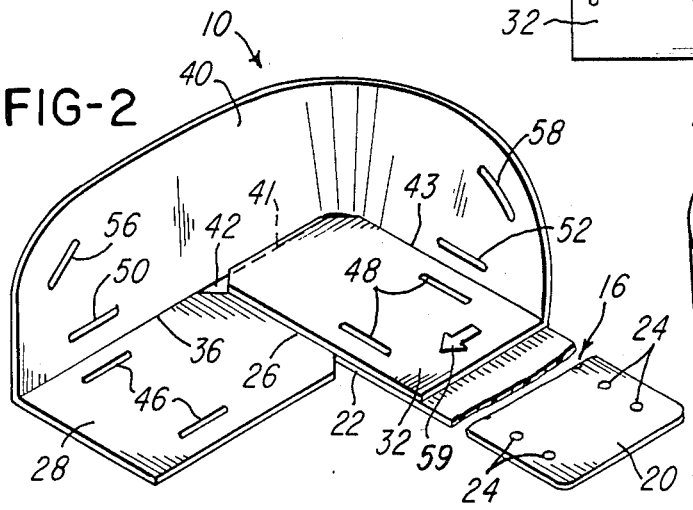
FIG. 2 is a fragmentary perspective view, illustrating a step in formation of the single piece of material into a base portion of ski binding structure.
Figure 3:
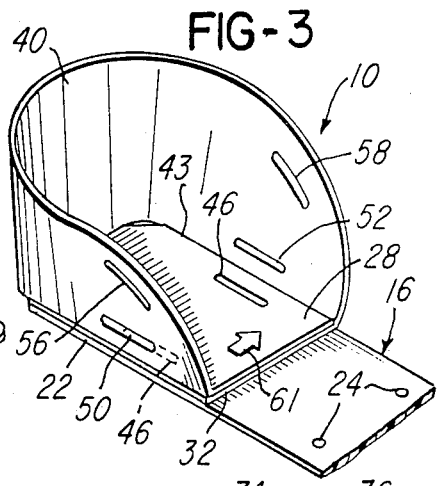
FIG. 3 is a fragmentary perspective view illustrating another step in formation of the single piece of material into a base portion of ski binding structure.
Figure 4:
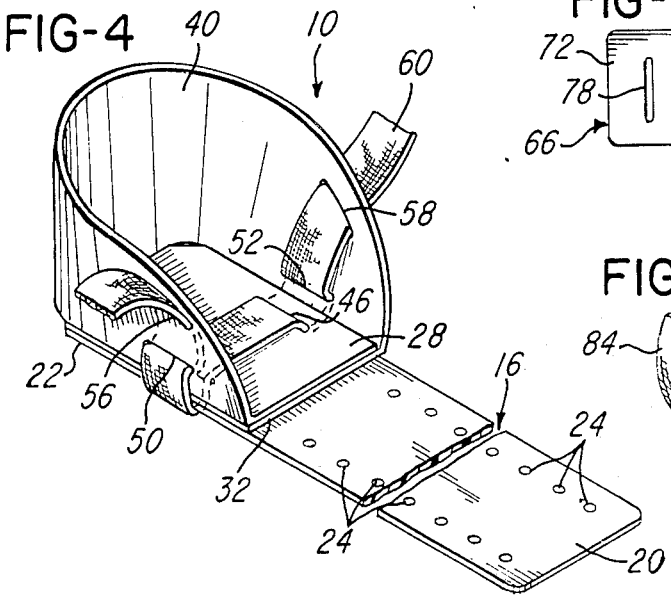
FIG. 4 is a perspective view, with parts broken away and shown in section, of the one-piece base portion and illustrating a securing member combined with the base portion.

As illustrated in FIGS. 2,3, and 4, the flap portions 28, 32, and 40 are movable with respect to the elongate attachment portion 16. With the attachment portion 16 maintained horizontal, the flap portion 40 is moved to a vertical position by folding along the fold lines 36, 41, and 43 as illustrated in FIG. 2. Then as the flap portion 32 is maintained horizontal, the flap portion 32 is moved through substantially a right angle, as illustrated by an arrow 59 in FIG. 2 to a position immediately above the connection part 22 of the attachment portion 16, as shown in FIG. 2. In this position of the flap portion 32, the slots 48 of the flap portion 32 are immediately above and in alignment with the slots 44 of the connection part 22 of the attachment portion 16. Then, as the flap portion 28 is maintained horizontal, the flap portion 28 is moved through substantially a right angle, as illustrated by an arrow 61 in FIG. 3 to a position immediately above the flap portion 32, as illustrated in FIG. 3. In this position of the flap portion 28, the slots 46 of the flap portion 28 are immediately above and in alignment with the slots 48 of the flap portion 32 and above and in alignment with the slots 44 of the connection part 22 of the attachment portion 16.

This formation of the flap portions 28, 32, and 40 and the attachment portion 16 is shown in FIG. 3 as comprising a heel receiving receptacle. In this formation the connection portion 22, and the flap portions 28 and 32 serve as a heel support region, and the flap portion 40 serves as a heel enclosure region.

Then, as illustrated in FIG. 4, a securing member, such as a strap 60, is inserted through the slot 58 of the flap portion 40 and then through the slot 52 of the flap portion 40. Then the strap 60 is extended to the exterior of the flap portion 40 and upwardly through one of the slots 44 of the connection portion 22, then through one of the slots 48 of the flap portion 32, and then through one of the slots 46 of the flap portion 28. Then, as shown in FIG. 4, the strap 60 is extended across the flap portion 28 and is extended downwardly through one of the slots 46 of the flap portion 28, then through one of the slots 48 of the flap portion 32, and then through one of the slots 44 of the connection portion 22. Then the strap 60 is extended to a position below the connection part 22 of the attachment portion 16. The strap 60 is then extended to a position exterior of the flap portion 40 and then into the slot 50 of the flap portion 40 and then outwardly through the slot 56 of the flap portion 40, as illustrated in FIG. 4.

Insertion of the strap 60 has been described with regard to a left ski. With regard to a right ski, the strap 60 is inserted in a reverse manner.

Figure 5:
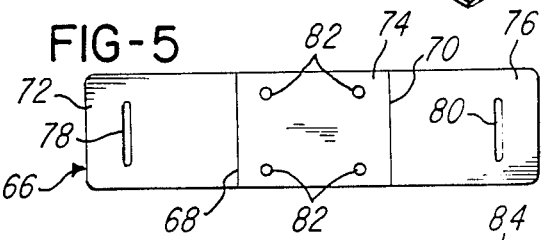
FIG. 5 is a lay-out view or plan view of a one-piece toe portion of ski binding structure of this invention.
Figure 6:
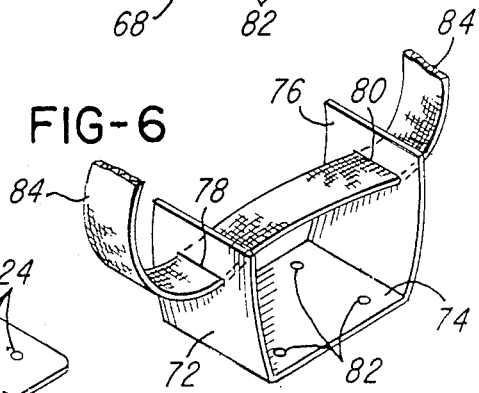
FIG. 6 is a fragmentary perspective view showing the toe portion of the ski binding structure in formation to receive a toe of a boot and including an attachment member joined to the toe portion.
Figure 7:
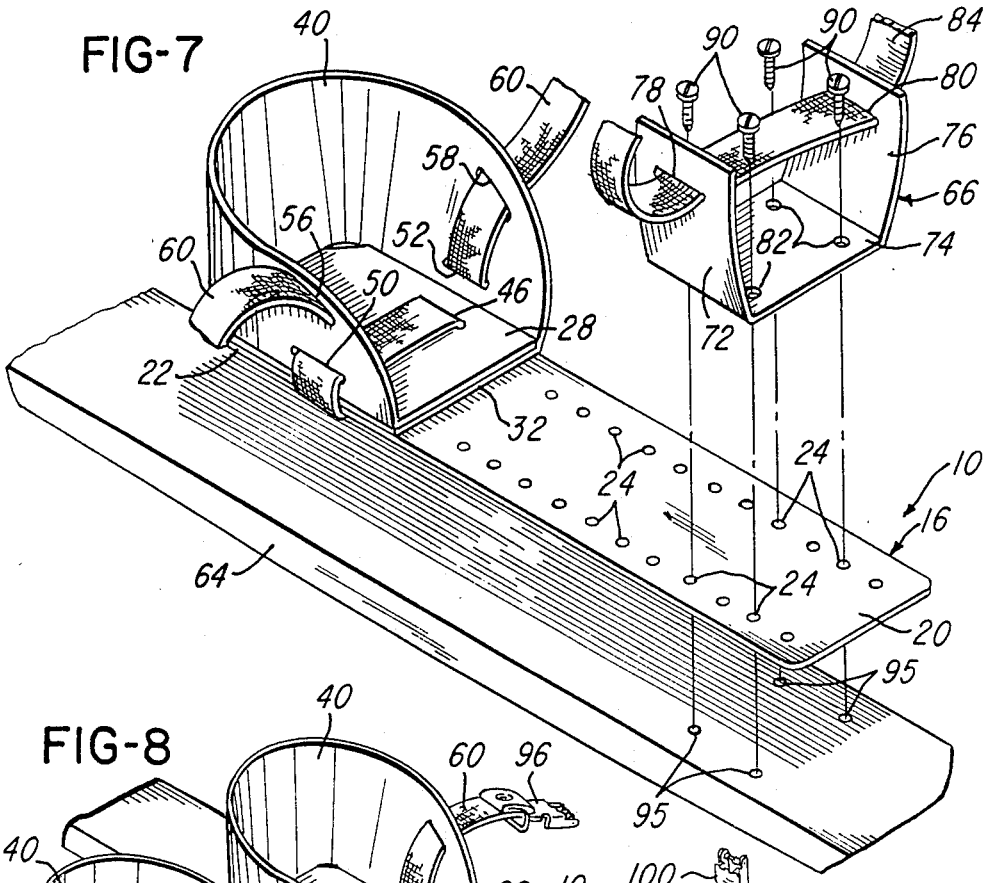
FIG. 7 is a fragmentary perspective exploded view showing the ski binding structure of FIGS. 1–6 and illustrating attachment of the ski binding structure to a ski.

As illustrated in FIG. 7, the base 10 is thus prepared for attachment to a ski 64. However, prior to attachment of the base 10 to the ski 64, a toe section 66 is formed in the manner illustrated in FIGS. 5 and 6. As shown in FIGS. 5 and 6, the toe section 66 is formed from a single sheet of material, such as the material from which the base 10 is formed. The toe section 66, as shown in FIG. 5, is elongate, with spaced-apart fold lines 68 and 70. The fold lines 68 and 70 separate the toe section 66 into a flap portion 72 and a flap portion 74, and a flap portion 76. The flap portion 72 has a slot 78 and the flap portion 76 has a slot 80. The flap portion 74 has a plurality of apertures 82.

The flap portions 72 and 76 are folded along the fold lines 68 and 70, respectively, and positioned angularly with respect to the flap portion 74, as illustrated in FIG. 6. Then a securing member, such as a portion 72 and through the slot 80 of the flap portion 76, as shown in FIG. 6.

Then, as illustrated in FIG. 7, the toe section 66 is placed above the attachment portion 24 of the base 10. Then fastener members, such as screws 90, are inserted through the apertures 82 of the flap portion 74, and through apertures 24 in the attachment portion 16 of the base 10. Then the screws 90 are inserted into holes 95 to attach the attachment portion 16 to the ski 64. Thus, the toe section 66 and the attachment portion 16 of the base 10 are attached to the ski 64.

Figure 8:
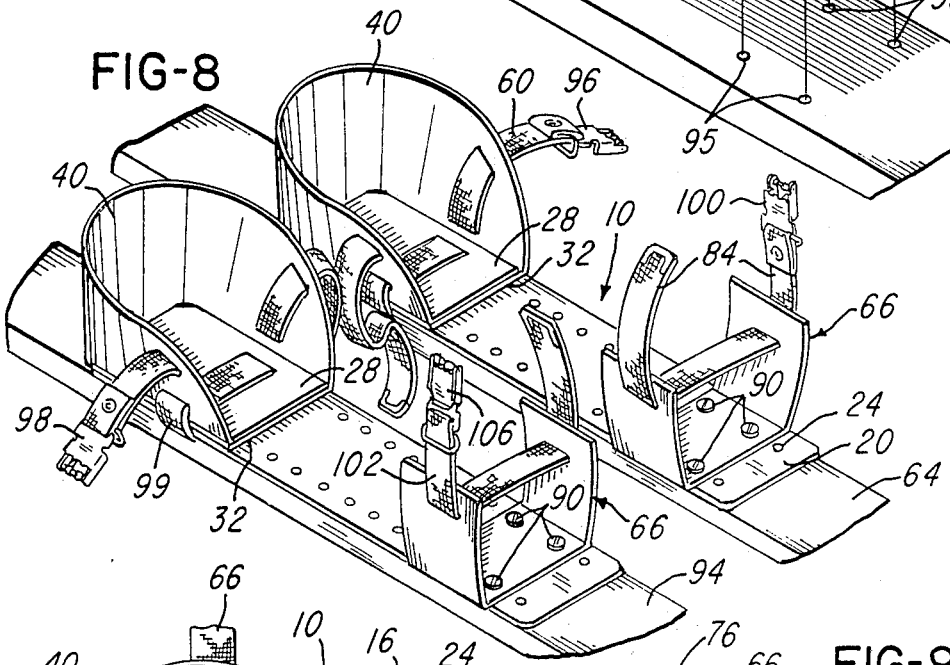
FIG. 8 is a fragmentary perspective view illustrating a pair of ski binding structures constructed according to this invention and attached to a pair of skis and illustrating use thereof as a right boot binding structure and as a left boot binding structure.

FIG. 8 shows portions of a pair of skis 64 and 94, with the ski 64 serving as a left ski and the ski 94 serving as a right ski. This figure shows a buckle 96 attached to the strap 60 of the ski binding structure which is attached to the left ski 64 and a buckle 98 attached to a strap 99 of the ski binding structure which is attached to the right ski 94. The strap 84 of the toe section 66 of the left ski 64 has a buckle 100, and a strap 102 of the toe section of the right ski 94 has a buckle 106. Therefore, the buckles 96, 98, 100, and 106 are on the outside parts of the ski binding structures, so that they do not interfere with ski action. Thus, ski binding structure of this invention is readily adapted for use with either a right boot and ski or a left boot and ski. Thus, the skis 64 and 94 are prepared for ski activity, as the heel portion of a person's boot is positioned within the flap portions 28, 32 and 40, and as the toe portion of a person's boot is positioned within the toe sections 66 of the skis 64 and 94.

Figure 9:
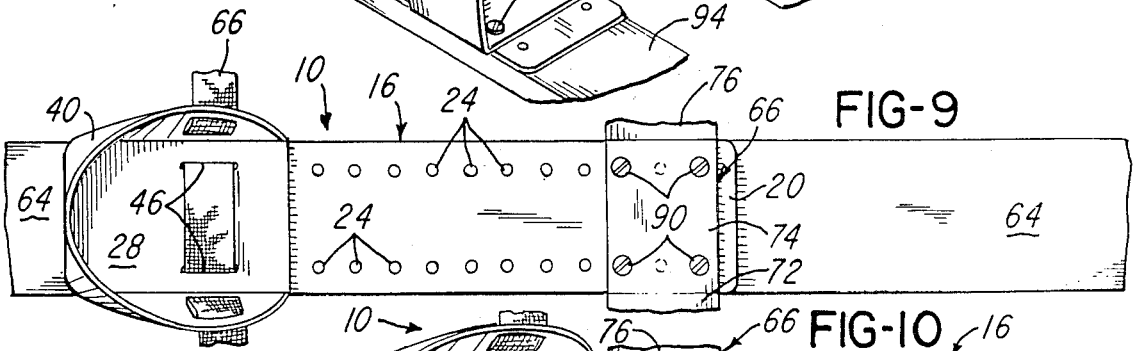
FIG. 9 is a fragmentary plan view, with parts shown broken away, of a ski binding structure of this invention, illustrating attachment thereof to a ski and adjusted to receive a relatively large boot.
Figure 10:
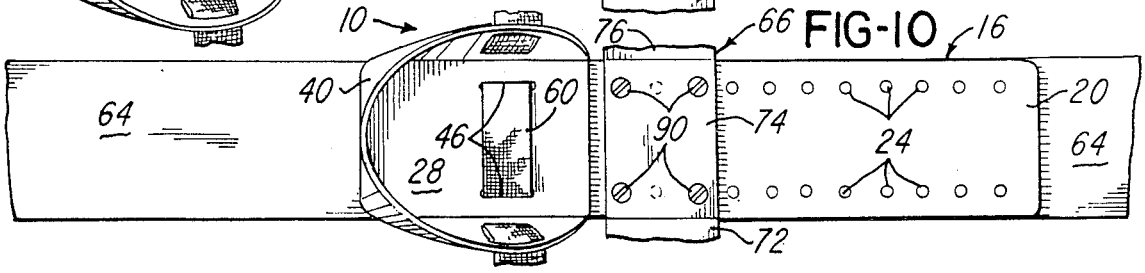
FIG. 10 is a plan view, similar to FIG. 9, illustrating attachment of the ski binding structure to a ski and adjusted to receive a relatively small boot.

As illustrated, the apertures 24 along the length of the elongate portion 16 are adapted to have a toe section 66 attached thereto, to accomodate a boot of any size between a relatively small size and a relatively large size. As illustrated in FIG. 9, the toe section 66 can be attached adjacent the end part 20 of the attachment portion 16 of the base 10. Thus, a relatively large shoe or boot is accommodated. FIG. 10 shows the toe section 66 attached to the attachment portion of the base 10 adjacent the flaps 28, 32, and 40. Thus, a relatively small shoe or boot is accommodated.

FIGS. 11-15

FIGS. 11-15 illustrate another embodiment of the ski binding structure of this invention.

FIG. 11 is a lay-out view which shows an elongate attachment portion or bottom portion 116 which has an end part 120 and a connection part 122. The elongate attachment portion 116 is provided with a series of pairs of apertures 124. The connection portion 122 is provided with a pair of slots 126.

FIG. 12 is a lay-out view which shows a heel section 130 which has a connection flap portion 132 which is provided with a pair of slots 134. A cut line 136 separates the connection flap portion 132 from flap portion 138. The flap portion 138 has a pair of slots 140. A cut line 144 separates the flap portion 132 from a flap portion 146. The flap portion 146 has a pair of slots 148. A fold line 150 joins the flap portion 138 and to an elongate flap portion 156. A fold line 151 joins the flap portion 132 to the elongate flap portion 156. A fold line 152 joins the flap portion 146 to the elongate flap portion 156.

The elongate flap portion 156 has a slot 160 adjacent the fold line 150 and in lateral alignment with the slots 140 of the flap portion 138. The flap portion 156 also has a slot 164 adjacent the fold line 152 and in lateral alignment with the slots 148 of the flap portion 146. The flap portion 156 also has a slot 170 spaced from the slot 160 and angular with respect thereto. The flap portion 156 also has a slot 174 spaced from the slot 164 and angular with respect thereto.

The flap portions 138, 146 and 156 are moved with respect to the connection flap portion 132, as illustrated in FIG. 13. With the portions 132, 138, and 146 horizontal, the elongate flap portion is moved upwardly about the fold lines 150, 151, and 152. Then, while the flap portion 146 is maintained horizontal, the flap portion 146 is moved angularly to a position immediately above the connection flap portion 132. With the flap portion 138 maintained horizontal, the flap portion 138 is moved angularly to a position immediately above the flap portion 146. Thus, the slots 140 of the flap portion 138, and the slots 148 of the flap portion 146, and the slots 134 of the connection flap portion 132 are in vertical alignment. Thus, the flap portions 132, 138, and 146 become a support section, and the flap portion 156 becomes an enclosure section, as shown in FIG. 13.

Then, as shown in FIG. 13, a securing member, such as a strap 180, is inserted through the slot 170 of the flap portion 156 and then along the inner surface of the flap portion 156 and then outwardly through the slot 160 of the flap portion 156. Then the strap 180 is extended around the edges of the flap portions 138, 146 and 132. Then the strap 180 is extended around the edge of the connection part 122 of the attachment portion 116. Then the strap 180 is brought upwardly through one of the slots 126 of the attachment portion 116, then through one of the slots 134 of the flap portion 132, then through one of the slots 148 of the flap portion 146, then through one of the slots 140 of the flap portion 138.

Then the strap 180 is extended across the upper surface of the flap portion 138 and then downwardly through one of the slots 140 of the flap portion 138. Then, the strap 180 is inserted through one of the slots 148 of the flap portion 146, then through one of the slots 134 of the flap portion 132. Then the strap 180 is extended along the exterior surface of the flap portion 156 and then through the slot 164 and then along the interior surface of the flap portion 156 and then outwardly through the slot 174. Thus, the heel section 130 is attached to the connection part 122 of the attachment portion 116.

A toe section 200 is shown in FIGS. 13, 14 and 15. The toe section 200 has a flap portion 204 and a flap portion 206, which are separated by a flap portion 210. The flap portion 204 has slots 220 and 222. The flap portion 206 has slots 228 and 230. The flap portion 210 has a plurality of aperatures 240.

As shown in FIGS. 13 and 15, a securing member, in the form of a strap 250, is inserted through the slot 230 of the flap portion 206, then along the interior surface of the flap 206 and then outwardly through the slot 228 of the flap portion 200. Then the strap 250 is extended along the lower surface of the flap portion 210 and then along the exterior surface of the flap portion 204 and through the slot 222 of the flap portion 204. Then the strap 250 is extended along the interior surface of the flap portion 204. Then the strap 250 is inserted through the slot 220 of the flap portion 204. Thus, the strap 250 is attached to the toe section 200.

Then fastener members, such as screws 300, are inserted through the apertures 240 of the flap portion 210 and are then inserted through selected apertures 124 in the elongate portion 116. The screws 300 are then inserted into holes 346 of a ski 350, as illustrated in FIG. 13. Thus, the ski binding structure of FIGS. 11, 12, 13, 14 and 15 is attached to the ski 350.

The toe section 200 can be attached to any desired part of the elongate portion 116 by selecting a desired set of aperture 124 of the attachment portion 116. Thus, the ski binding structure of FIGS. 11-15 is adjustable to accomodate a large boot or a small boot.

Although the preferred embodiment of the ski binding structure and method of this invention have been described, it will be understood that within the purview of this invention various changes may be made in the form, details, proportion and arrangement of parts, the combination thereof, and the methods involved, which generally stated consist in a structure and/or method within the scope of the appended claims.

The invention having thus been described, the following is claimed:

1. Ski binding structure for attachment to a snow ski, the ski binding structure being adapted to receive a ski boot or the like, comprising:

a receptacle member adapted to receive at least a portion of a ski boot or the like including a single piece of material having a plurality of portions which are folded one with respect to the other, there being a bottom portion, a pair of side portions and an enclosure portion, the side portions being separated from the bottom portion by cut lines, the enclosure portion being joined to the bottom portion and to the side portions by fold lines, the side portions being positioned one upon the other and positioned upon the bottom portion, the enclosure portion extending upwardly from the bottom portion and from the side portions, the enclosure portion encompassing at least part of the side portions and the bottom portion, whereby a receptacle is formed to receive a part of a ski boot or the like, as a part of the ski boot is positioned upon one of the side portions and above the side portions and above the bottom portion, and as a part of the ski boot is partially encompassed by the enclosure portion, and means for attachment of at least one of the portions to a ski.

2. The ski binding structure of claim 1 in which the receptacle which is formed is adapted to receive a heel part of a ski boot or the like and in which the bottom portion is elongate and provided with a plurality of connection portion, and in which the ski binding structure includes a toe section, means for adjustably attaching the toe section to any one of the connection portions of the bottom portion, and means for attaching the bottom portion and the toe section to a ski.

3. The ski binding structure of claim 1 which includes an elongate attachment member having a part positioned upon the bottom portion, the elongate attachment member being provided with a slot therethrough, the bottom portion being provided with a slot therethrough, each of the side portions being provided with a slot therethrough, a strap extending through the slots in the attachment member and in the bottom portion and in the side portions, the strap thus attaching the elongate attachment member to the side portions and to the bottom portion.

4. The ski binding structure of claim 1 in which the bottom portion is elongate and extends from the other portions, the bottom portion being provided with a series of apertures for adjustable attachment to a ski.

5. Ski binding structure for attachment to a snow ski and for receiving a ski boot or the like comprising:

a receptacle member adapted to receive a portion of a ski boot or the like including a single piece of material having a plurality of portions which are folded one with respect to the others, there being a bottom portion, a pair of side portions and an enclosure portion, the side portions being positioned one upon the other and positioned above the bottom portion, the side portions and the bottom portion being adapted to be generally horizontal, the enclosure portion encompassing a part of the side portions and the bottom portion and extending upwardly therefrom, a receptacle thus being formed to receive a part of a ski boot or the like as a part of the ski boot rests upon a side portion and is above the side portions and above a part of the bottom portion and as a part of the ski boot is partially encompassed by the enclosure portion, and attachment means for attachment of the bottom portion to a ski.

6. The ski binding structure of claim 5 in which the attachment means includes an elongate attachment member, and means attaching the elongate attachment member to the bottom portion of the receptacle member.

7. The ski binding structure of claim 5 in which the attachment means includes an elongate attachment member provided with a slot therein, and in which the bottom portion is provided with a slot therein, and strap means extending through the slots and attaching the elongate attachment member to the bottom portion of the receptacle member.

8. The ski binding structure of claim 5 wherein the bottom portion includes a series of connection portions, and means for attachment of any one of the connection portions to a ski.

9. Ski binding structure for retaining footwear of a skier comprising a sheet of material provided with an attachment portion, the attachment portion including means for attachment to a ski, a pair of side portions, and an enclosure portion, the side portions and the attachment portion being adapted to be substantially horizontal, the side portions being positioned one upon the other and above the attachment portion, the enclosure portion extending upwardly from the attachment portion and from the side portions, the enclosure portion partially encompassing the side portions and the attachment portion, the attachment portion and the side portions and the enclosure portion thus forming a receptacle to receive footwear as the footwear is positioned above the side portions and the attachment portion and as a part of the footwear is partially encompassed by the enclosure portion, and means for attaching the attachment portion to a ski.

10. The ski binding structure of claim 9 in which the attachment portion is elongate in configuration, and in which the attachment portion includes means along the length thereof for adjustable attachment of the attachment portion to a ski.

11. The ski binding structure of claim 9 in which the receptacle is adapted to receive the heel of a ski boot, and in which the attachment portion is elongate in configuration, and in which the attachment portion is provided with means along the length thereof for adjustable attachment to a ski, and in which the ski binding structure includes a ski boot toe receptacle member, the ski boot toe receptacle member being positioned upon the elongate attachment portion and attached to the elongate attachment portion.

12. The ski binding structure of claim 9 which includes a toe section, means attaching the toe section to the attachment portion, and means for attaching the toe section and the attachment portion to a ski.

13. The ski binding structure of claim 9 in which the attachment portion is elongate in configuration, and in which the attachment portion includes a plurality of attachment sections and means for attachment of any one of the attachment sections to a ski boot.

14. The method of producing ski binding structure for attachment to a ski and for receiving a ski boot or the like, comprising:

forming a single sheet of material into a plurality of portions, including an attachment portion, a pair of side portions including a first side portion and a second side portion, forming a cut line between the attachment portion and the first side portion, forming a cut line between the attachment portion and the second side portion, forming an enclosure portion, forming a fold line between the enclosure portion and the first side portion and forming a fold line between the enclosure portion and the attachment portion and forming a fold line between the enclosure portion and the second side portion, and forming a fold line between the enclosure portion and the attachment portion, moving the side portions to positions one upon the other and upon the attachment portion, folding the enclosure portion to a position which partially encompasses the attachment portion and the side portions, the formation of the side portions and the attachment portion and the enclosure portion thus forming a receptacle for a portion of a ski boot or the like.

15. The method of claim 14 which includes forming the attachment portion into an elongate configuration, and which includes forming a second sheet of material into a toe receiving configuration, followed by attaching the second sheet of material to a part of the attachment portion, followed by attaching the elongate attachment portion and the second sheet of material to a ski.

16. The method of claim 14 which includes forming a slot in each of the portions, followed by inserting a strap through the slot in each of the portions, whereby portions are secured together for securing a part portion of a boot in engagement with the enclosure portion.

17. The method of producing a ski binding structure for attachment to a ski and for receiving a boot or the like comprising:

forming a flat sheet of material into an attachment portion, a pair of side portions, and an enclosure portion, separating the side portions from the attachment portions, with the enclosure portion attached to the attachment portion, followed by moving the side portions to positions one upon the other and upon the attachment portion, whereby the side portions cover the attachment portion, and folding the enclosure portion with respect to the attachment portion and to a position which partially encompasses the attachment portion and the side portions to form a receptacle which is adapted to receive a portion of a boot or the like.

18. The method of claim 17 which includes forming a slot in each of the portions, followed by inserting a strap through the slot in ech of the portions for retaining the portions in formation and for maintaining a portion of a boot in contact with the enclosure portion.

19. The method of claim 17 which includes forming the attachment portion into an elongate configuration for attachment of a part of the attachment portion to a ski, in which the part of the attachment portion is spaced from the enclosure portion.

20. The method of claim 17 which includes forming the attachment portion into an elongate configuration for attachment of the attachment portion to a ski, forming an elongate strip of material into a generally U-shape element, to receive a portion of a boot or the like, followed by attaching the elongate strip of material to the elongate attachment portion and to a ski.

21. The method of claim 17 which includes forming an elongate strip of material, followed by attaching the elongate strip of material to the attachment portion of the folded sheet of material.

22. The method of claim 17 which includes attaching a strap to each of the portions to retain the portions in receptacle formation.

23. The method of claim 17 which includes forming an elongate strip of material, followed by attaching a strap to each of the portions of the folded sheet of material and attaching the strap to the elongate strip of material for securing the folded sheet of material to the elongate strip of material and for retaining a portion of a boot which is enclosed by the enclosure portion.

24. The method of claim 17 which includes forming an elongate strip of material, followed by inserting a strap through each of the portions of the folded sheet of material and through the elongate strip of material for attaching the receptacle formation to the elongate strip of material and for retaining a portion of a boot in engagement with the enclosure portion, forming a toe member, followed by attaching the toe member to the elongate strip of material and to a ski.

25. The method of claim 17 which includes forming an elongate attachment member, attaching the elongate attachment member to the attachment portion which is covered by the side portions.

* * * * *

UNITED STATES PATENT AND TRADEMARK OFFICE

CERTIFICATE OF CORRECTION

PATENT NO. : 4,772,041

DATED : September 20, 1988

INVENTOR(S) : James E. Klosterman

It is certified that error appears in the above-identified patent and that said Letters Patent are hereby corrected as shown below:

Column 1, line 6, change "skss" to ---skis---.

Column 4, line 50, after "a", second occurrence, insert the following: ---strap 84, is inserted through the slot 78 of the flap---.

Signed and Sealed this

Seventh Day of March, 1989

*Attest:*

DONALD J. QUIGG

*Attesting Officer*

*Commissioner of Patents and Trademarks*